US010294691B1

(12) United States Patent
Goncher

(10) Patent No.: US 10,294,691 B1
(45) Date of Patent: May 21, 2019

(54) PORTABLE SHELTER WITH ROOFTOP OPENING

(71) Applicant: Nicholas Joseph Goncher, Steger, IL (US)

(72) Inventor: Nicholas Joseph Goncher, Steger, IL (US)

( * ) Notice: Subject to any disclaimer, the term of this patent is extended or adjusted under 35 U.S.C. 154(b) by 0 days.

(21) Appl. No.: 15/909,105

(22) Filed: Mar. 1, 2018

(51) Int. Cl.
*E04H 15/16* (2006.01)
*E04H 15/64* (2006.01)
*E04H 15/50* (2006.01)
*E04H 15/44* (2006.01)

(52) U.S. Cl.
CPC ..... *E04H 15/16* (2013.01); *E04H 15/64* (2013.01); *E04H 15/44* (2013.01); *E04H 15/50* (2013.01)

(58) Field of Classification Search
CPC ..... E04H 15/16; E04H 15/10; E04H 15/18; E04H 15/54
USPC ..... 135/93
See application file for complete search history.

(56) References Cited

U.S. PATENT DOCUMENTS 1,428,343 A * 9/1922 Thackeray ..... E04H 15/16 135/100
2,527,729 A 10/1950 Hoff
3,181,543 A * 5/1965 Petrie ..... E04H 15/16 135/100
D231,922 S 6/1974 Cole
3,896,830 A * 7/1975 Sharick ..... E04H 15/10 135/116
4,173,855 A 11/1979 Raptoplous
4,426,814 A 1/1984 Stuhmer
4,838,293 A 6/1989 Novak
5,836,331 A 11/1998 Grahn
6,021,796 A * 2/2000 Vavra ..... E04H 15/16 135/121
6,745,521 B1 6/2004 Klemming
6,996,941 B1 2/2006 Maschoff
7,686,026 B2 * 3/2010 Carter ..... E04H 15/48 135/144
8,132,584 B2 * 3/2012 Lane ..... E04H 15/54 135/115
8,375,969 B2 2/2013 McCarty, Sr.
9,556,639 B2 1/2017 Hunt et al.
(Continued)

FOREIGN PATENT DOCUMENTS

GB 2442816 A 4/2008

*Primary Examiner* — Noah Chandler Hawk
(74) *Attorney, Agent, or Firm* — Harness, Dickey & Pierce, P.L.C.

(57) ABSTRACT

A portable shelter including a canopy frame with frame support beams that are connected at corner junctions to define a frame perimeter. Roof support beams extend from the corner junctions to a rooftop peak. A base including legs is connected to the canopy frame at the corner junctions. A canopy extends over the canopy frame to form a roof. The canopy may be attached to the base and/or the canopy frame by hook-and-loop fastener strips. A rooftop opening is provided in the canopy adjacent the rooftop peak to allow smoke to escape from under the canopy when a fire is lit under the portable shelter. A removable top cap is retained over the rooftop opening by a magnetic coupling that allows the rooftop opening to be closed when not in use. Partial side curtains may be provided that cover only a lower half of the base.

14 Claims, 10 Drawing Sheets

(56) References Cited

U.S. PATENT DOCUMENTS

| | | | | |
|---|---|---|---|---|
| 2004/0238021 | A1* | 12/2004 | Holub | E04H 15/18 135/97 |
| 2007/0204551 | A1 | 9/2007 | Izardel | |
| 2009/0095337 | A1* | 4/2009 | Carter | E04H 15/50 135/143 |

* cited by examiner

PORTABLE SHELTER WITH ROOFTOP OPENING

FIELD

The present disclosure relates to portable shelters, canopies, sunshades, tents, awnings, and gazebos. More particularly, the present disclosure relates to portable shelters with a rooftop opening for venting smoke produced by a stationary fire pit, portable fire pit, fire ring, camp fire, fire table, barbeque, grill, or cooktop located underneath the portable shelter.

BACKGROUND

The statements in this section merely provide background information related to the present disclosure and may not constitute prior art.

A wide variety of portable canopies, sunshades, tents, awnings, and gazebos are available that offer shelter from the sun, wind, rain, snow, and insects. Such portable shelters are often used during camping, tailgating, or at other outdoor events and activities. Typical designs include a fabric canopy that is supported by a frame. The frame is designed to be assembled and disassembled easily and quickly. In some designs, the frame is constructed from a number of bars or tubes that can be connected and disconnected from one another without the use of any tools (i.e., that can be broken down by hand). In other designs, the frame is configured to fold-up into a more compact package for transportation and storage. The canopy is attached to the top of the frame to form a roof. Typically, the canopy is tied to the frame by rope or bungee cords. In most designs, the sides of the frame are left completely open; however, some designs include full-length side curtains that can be attached to the frame to provide a fully-enclosed shelter with zippered doors or flaps for ingress and egress.

Portable shelters are often used during activities where people light outdoor fires and/or cook food over an open flame. Traditional portable shelters cannot be placed over or in the vicinity of stationary fire pits, portable fire pits, fire rings, camp fires, fire tables, barbeques, grills, cooktops, or other fire sources because the canopy traps smoke and can be damaged by the heat and cinders generated by the fire source. As such, individuals are forced to choose between seeking shelter from the elements (i.e., the sun, wind, rain, and snow) or from insects and leaving the shelter to sit or stand around a fire source or cook over an open flame. Traditional portable shelters also have the drawback of being unheated. Accordingly, there remains a need for portable shelters that are suitable for placement over stationary fire pits, portable fire pits, fire rings, camp fires, fire tables, barbeques, grills, cooktops, or other fire sources without compromising portability or their ability to provide shelter.

SUMMARY

This section provides a general summary of the disclosure, and is not a comprehensive disclosure of its full scope or all of its features.

In accordance with one aspect of the subject disclosure, a portable shelter is provided that includes a canopy frame, a base, and a canopy. The canopy frame includes a plurality of frame support beams and a plurality of roof support beams. The plurality of frame support beams are connected to one another at corner junctions to define a frame perimeter. The plurality of roof support beams extend from the corner junctions to a rooftop peak. The base includes a plurality of legs that are connected to the canopy frame. The plurality of legs include corner legs that are connected to the plurality of frame support beams at the corner junctions. The canopy extends over and is attached to the canopy frame to form a roof. A rooftop opening is provided in the canopy. The rooftop opening is positioned such that the canopy is open at the rooftop peak of the canopy frame. The rooftop opening allows smoke, ash, heat, and cinders to vent out from under the canopy without damaging the material of the canopy. A removable top cap is releasably retained over the rooftop opening by a magnetic coupling. The removable top cap allows the rooftop opening to be closed when not in use (i.e., when there is no fire or other fire source being used inside the portable shelter).

In accordance with another aspect of the subject disclosure, each of the legs of the base has an upper end that is connected to at least one of the plurality of frame support beams and a lower end opposite the upper end. Each of the legs therefore has a leg length that can be measured between the upper and lower ends and the base has a base height that equals the leg length. A midpoint is located along each leg that is equally spaced from the upper and lower ends of the leg. The base has an upper half disposed above the midpoints of the legs and a lower half disposed below the midpoints of the legs. One or more partial side curtains are attached to the base. Each partial side curtain extends between two of the legs at a position below the midpoint of the legs such that the partial side curtain covers only a portion of the lower half of the base. As a result, the one or more partial side curtains provide a wind break for a fire source disposed inside the portable shelter and for people sitting within the portable shelter while still permitting sufficient airflow to feed convection currents that pull the smoke, ash, heat, and cinders from the fire source up through the rooftop opening. Additionally, the one or more partial side curtains do not obstruct the view out of the portable shelter regardless of whether a person is sitting or standing inside the portable shelter.

In accordance with another aspect of the subject disclosure, the canopy includes an upper portion and a lower portion. The upper portion of the canopy extends over and is supported by the plurality of roof support beams. The lower portion of the canopy extends downwardly over the frame perimeter that is formed by the plurality of frame support beams. The rooftop opening is located in the upper portion of the canopy such that the upper portion of the canopy is open at the rooftop peak of the canopy frame. The canopy is removably attached to the base and/or the canopy frame by hook-and-loop fastener strips that are placed along the lower portion of the canopy. The placement of the hook-and-loop fastener strips along the lower portion of the canopy secure the canopy to the base and/or canopy frame without requiring the use of rope, bungee cords, or other fasteners. As a result, the canopy can be attached to and removed from the base and/or canopy frame in less time and with less effort.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
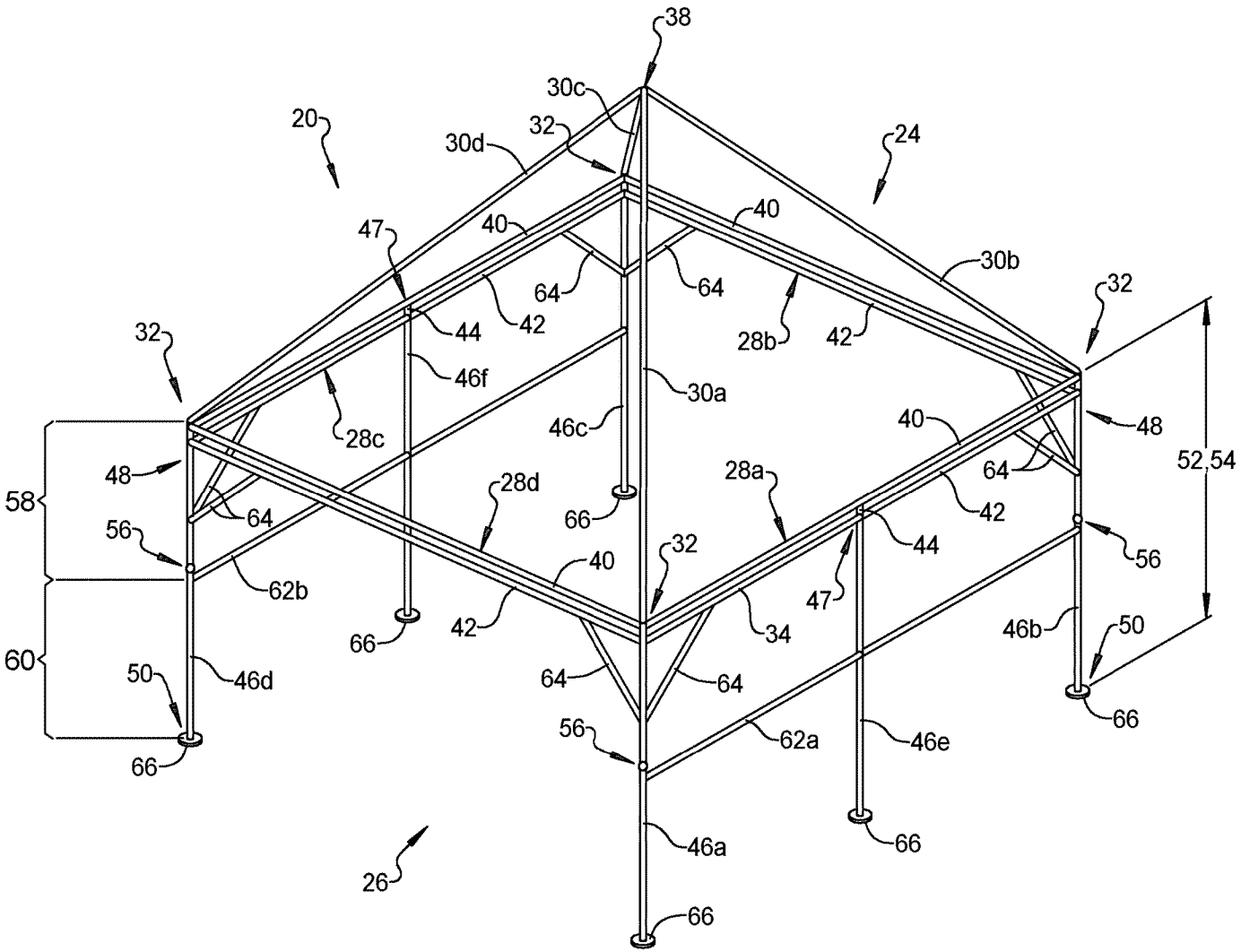
FIG. 1 is a front perspective view of an exemplary portable shelter constructed in accordance with the subject disclosure where a canopy frame and base of the portable shelter are shown.
Figure 2:
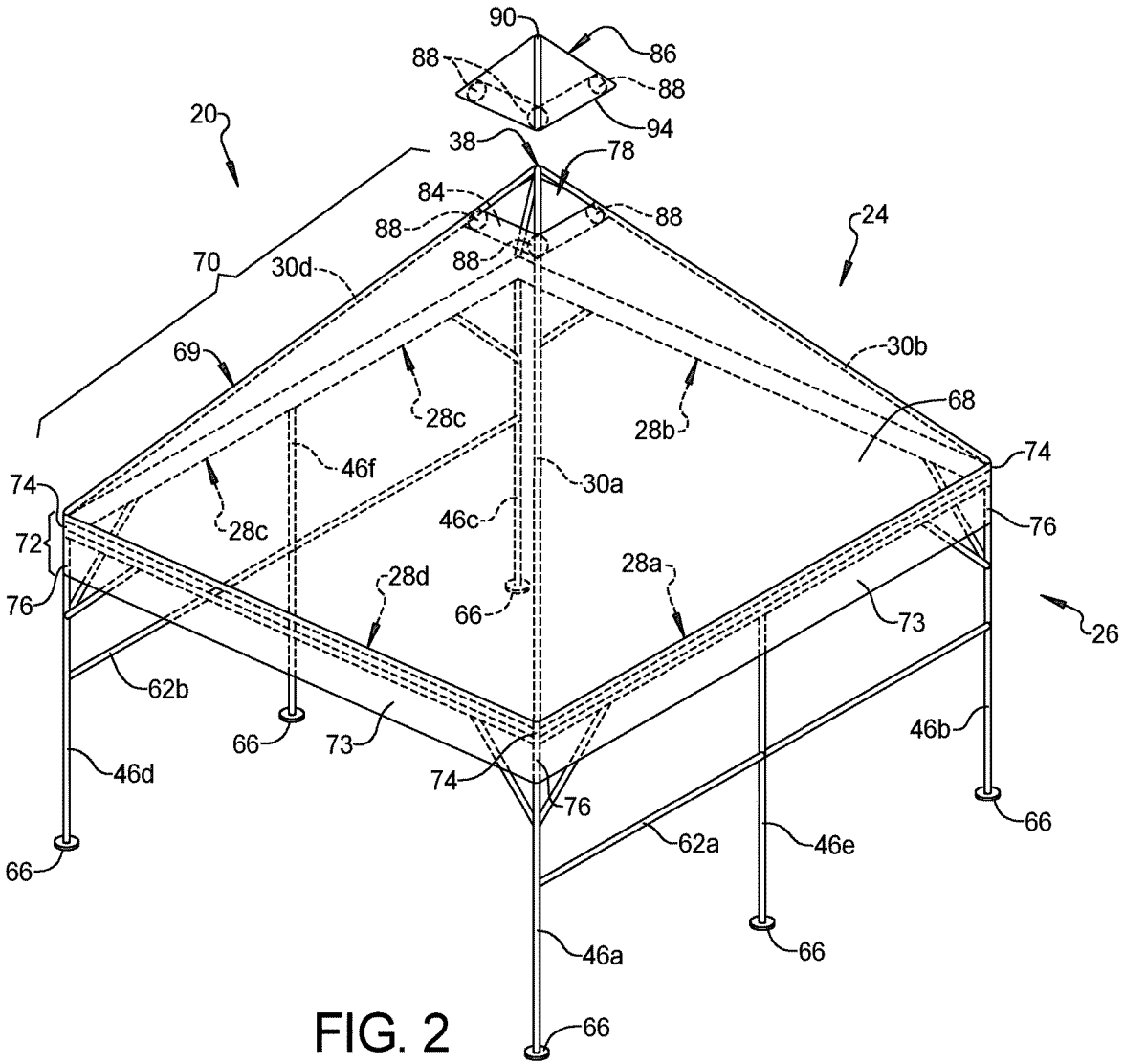
FIG. 2 is another front perspective view of the exemplary portable shelter illustrated in FIG. 1 where a canopy of the portable shelter is shown covering the canopy frame and a removable top cap is shown exploded out above the canopy.

Referring to the Figures, wherein like numerals indicate corresponding parts throughout the several views, a portable shelter 20 that is suitable for placement over stationary fire pits, portable fire pits, fire rings, camp fires, fire tables, barbeques, grills, cooktops, or other fire sources 22 is disclosed.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, the portable shelter 20 includes a canopy frame 24 and a base 26. The canopy frame 24 has a plurality of frame support beams 28*a-d* and a plurality of roof support beams 30*a-d*. The plurality of frame support beams 28*a-d* are connected at corner junctions 32 to define a frame perimeter 34. The plurality of roof support beams 30*a-d* extend at an upwardly directed angle 36 (FIGS. 4 and 5) from the corner junctions 32 to a rooftop peak 38. Although other configurations are possible, in the illustrated embodiment, the canopy frame 24 is shaped as a square right pyramid. This means that the plurality of frame support beams 28*a-d* are equal in length and the plurality of roof support beams 30*a-d* are equal in length such that the rooftop peak 38 is located at the center of the canopy frame 24. In accordance with this configuration, the plurality of frame support beams 28*a-d* includes a first frame support beam 28*a*, a second frame support beam 28*b*, a third frame support beam 28*c*, and a fourth frame support beam 28*d*. Similarly, the plurality of roof support beams 30*a-d* includes a first roof support beam 30*a*, a second roof support beam 30*b*, a third roof support beam 30*c*, and a fourth roof support beam 30*d*. Further, each of the frame support beams 28*a-d* comprises an upper horizontal tube 40 and a lower horizontal tube 42 that are spaced apart and that run parallel to each other. The upper and lower horizontal tubes 40, 42 of each of the frame support beams 28 may be connected by vertical junction tubes 44. It should be appreciated that other configurations are possible. By way of example and without limitation, the frame perimeter 34 formed by the plurality of frame support beams 28*a-d* may be rectangular in shape instead of the square shape shown in the Figures. Other shapes for the canopy frame 24 are also possible, including without limitation, non-right pyramids having a frame perimeter 34 made up of 3, 4, 5, 6, 7, 8, 9, or 10 frame support beams. In addition, the frame support beams 28*a-d* may be constructed in different ways. For example, the frame support beams 28*a-d* may alternatively be made of a single tube, bar, or member.

The base 26 includes a plurality of legs 46*a-f* that are connected to the canopy frame 24. The plurality of legs 46*a-f* include corner legs 46*a-d* that are connected to the plurality of frame support beams 28*a-d* at the corner junctions 32. Optionally, the plurality of legs 46*a-f* may further include one or more intermediary legs 46*e*, 46*f*. Each intermediary leg 46*e*, 46*f* is disposed between two of the corner legs 46*a-d* and is connected to one of the frame support beams 28*a*, 28*c* at a connection 47 located between two of the corner junctions 32. Although other configurations are possible, in the illustrated embodiment, the plurality of legs 46*a-f* includes a first corner leg 46*a*, a second corner leg 46*b*, a third corner leg 46*c*, and a fourth corner leg 46*d*. The plurality of legs 46*a-f* also includes a first intermediary leg 46*e* that is arranged halfway between the first and second corner legs 46*a*, 46*b* and a second intermediary leg 46*f* that is arranged halfway between the third and fourth corner legs 46*c*, 46*d*. In the illustrated example, the plurality of legs 46*a-f* are arranged at right angles to the plurality of frame support beams 28*a-d*. However, it should be appreciated that other configurations are possible. By way of non-limiting example, the plurality of legs 46*a-f* may be angled outwardly to increase the stability of the base 26.

Each of the legs 46*a-f* has an upper end 48 that is connected to at least one of the plurality of frame support beams 28*a-d* (via a corner junction 32 or a connection 47) and a lower end 50 that is opposite the upper end 48. Each of the legs 46*a-f* has a leg length 52 that is measured between the upper end 48 and the lower end 50. The base 26 has a base height 54 that equals the leg length 52. Each of the legs 46*a-f* includes a midpoint 56 that is located along the leg length 52 halfway between the upper end 48 and the lower end 50 (i.e., the midpoint 56 is equally spaced between the upper and lower ends 48, 50). The base 26 therefore has an upper half 58 that is disposed above the midpoint 56 of the legs 46 and a lower half 60 disposed below the midpoint 56 of the legs 46. Although the size of the portable shelter 20 may vary, in the illustrated embodiment, each of the frame support beams 28*a-d* is approximately 120 inches long, each of the roof support beams 30*a-d* is approximately 68 inches long. In the illustrated embodiment, the leg length 52 for each of the legs 46*a-f* and therefore the base height 54 is approximately 74 inches. This means that the midpoint 56 of each of the legs 46*a-f* is approximately 37 inches high.

Optionally, the base 26 may further include one or more cross-beams 62*a*, 62*b* that extend between two of the legs 46*a-f*. Although the number of cross-beams 62*a*, 62*b* may vary, in the illustrated embodiment, the base 26 includes a first cross-beam 62*a* that extends between the first and second corner legs 46*a*, 46*b* and a second cross-beam 62*b* that extends between the third and fourth corner legs 46*c*, 46*d*. The cross-beams 62*a*, 62*b* extend horizontally and at right angles to the legs 46*a-f* and are connected to the legs 46*a-f* between the lower end 50 and the midpoint 56 of the legs 46*a-f*. By way of example and without limitation, the cross-beams 62*a*, 62*b* in the illustrated embodiment are connected to the legs 46*a-f* at a location that is approximately 35 inches from the lower end 50 of the legs 46*a-f* (or approximately 2 inches below the midpoint 56 of the legs 46*a-f*).

The plurality of frame support beams 28*a-d*, roof support beams 30*a-d*, legs 46*a-f*, and cross-beams 62*a*, 62*b* can be made of a wide range of materials. By way of example, the plurality of frame support beams 28*a-d*, the plurality of roof support beams 30*a-d*, the plurality of legs 46*a-f*, and the cross-beams 62*a*, 62*b* can be made of plastic (e.g., PVC pipes), aluminum, steel, or composite materials. The plurality of frame support beams 28*a-d*, roof support beams 30*a-d*, legs 46*a-f*, and cross-beams 62*a*, 62*b* may have a solid or hollow cross-section. The cross-sectional shape of the plurality of frame support beams 28*a-d*, roof support beams 30*a-d*, legs 46*a-f*, and cross-beams 62*a*, 62*b* can also vary and may be, for example, circular, rectangular, or square. The rooftop peak 38, corner junctions 32, and connections 47 may be separate components or alternatively may be integral with the plurality of frame support beams 28*a-d*, the plurality of roof support beams 30*a-d*, and/or the plurality of legs 46*a-f*. Regardless of the particular construction, the plurality of frame support beams 28*a-d*, roof support beams 30*a-d*, legs 46*a-f*, and cross-beams 62*a*, 62*b* are designed to be quickly and easily disconnected at the rooftop peak 38, corner junctions 32, and connections 47. As a result, the canopy frame 24 and the base 26 can quickly and easily be broken down and packed away for transportation and storage.

Optionally, a plurality of corner braces 64 may be provided that extend between and are connected to the plurality of frame support beams 28*a-d* and the corner legs 46*a-d*. A plurality of feet 66 may also be provided that are connected to the lower end 50 of the legs 46*a-f*. The plurality of feet 66 may each include holes (not shown) for receiving stakes (not shown) adapted to secure the portable shelter 20 to the ground. Alternatively, the stakes may be placed around (i.e. outboard of) the base 26 and ropes or cables (not shown) can be secured to the stakes at one end and the base 26 or canopy frame 24 at the other.

With additional reference to FIGS. 2-5, a canopy 68 extends over and is attached to the canopy frame 24 to form a roof 69. The canopy 68 is made of a fabric material. This allows the canopy 68 to be folded or rolled up for transportation and storage. In the illustrated example, the canopy 68 includes an upper portion 70 and a lower portion 72. The upper portion 70 of the canopy 68 extends over and is supported by the plurality of roof support beams 30*a-d*. Accordingly, the upper portion 70 of the canopy 68 in the illustrated example is shaped as a square right pyramid. The lower portion 72 of the canopy 68 extends downwardly over the frame perimeter 34, which is formed by the plurality of frame support beams 28*a-d*. Accordingly, the lower portion 72 of the canopy 68 has a rectangular shape with substantially vertical walls 73. The lower portion 72 of the canopy 68 has canopy corners 74 that extend over the corner junctions 32 of the canopy 68 roof.

Optionally, the canopy 68 is removably attached to the base 26 and/or the canopy frame 24 of the portable shelter 20 by hook-and-loop fastener strips 76. The hook-and-loop fastener strips 76 are also known as Velcro® strips. One side of the hook-and-loop fastener strips 76 are placed vertically along the lower portion 72 of the canopy 68 at the canopy corners 74. The other side of the hook-and-loop fastener strips 76 can be placed vertically in any one of the following locations: along the frame perimeter 34 on each of the corner junctions 32 of the canopy frame 24, on the upper end 48 of each of the corner legs 46*a-d*, on each of the connections 47 between the frame support beams 28*a*, 28*c* and the intermediary legs 46*e*, 46*f*, and/or on the upper end 48 of each of the intermediary legs 46*e*, 46*f*. The placement of the hook-and-loop fastener strips 76 along the lower portion 72 of the canopy 68 secures the canopy 68 to the base 26 and/or canopy frame 24 without requiring the use of rope, bungee cords, or other fasteners. As a result, the canopy 68 can be attached to and removed from the base 26 and/or canopy frame 24 in less time and with less effort.

Figure 4:
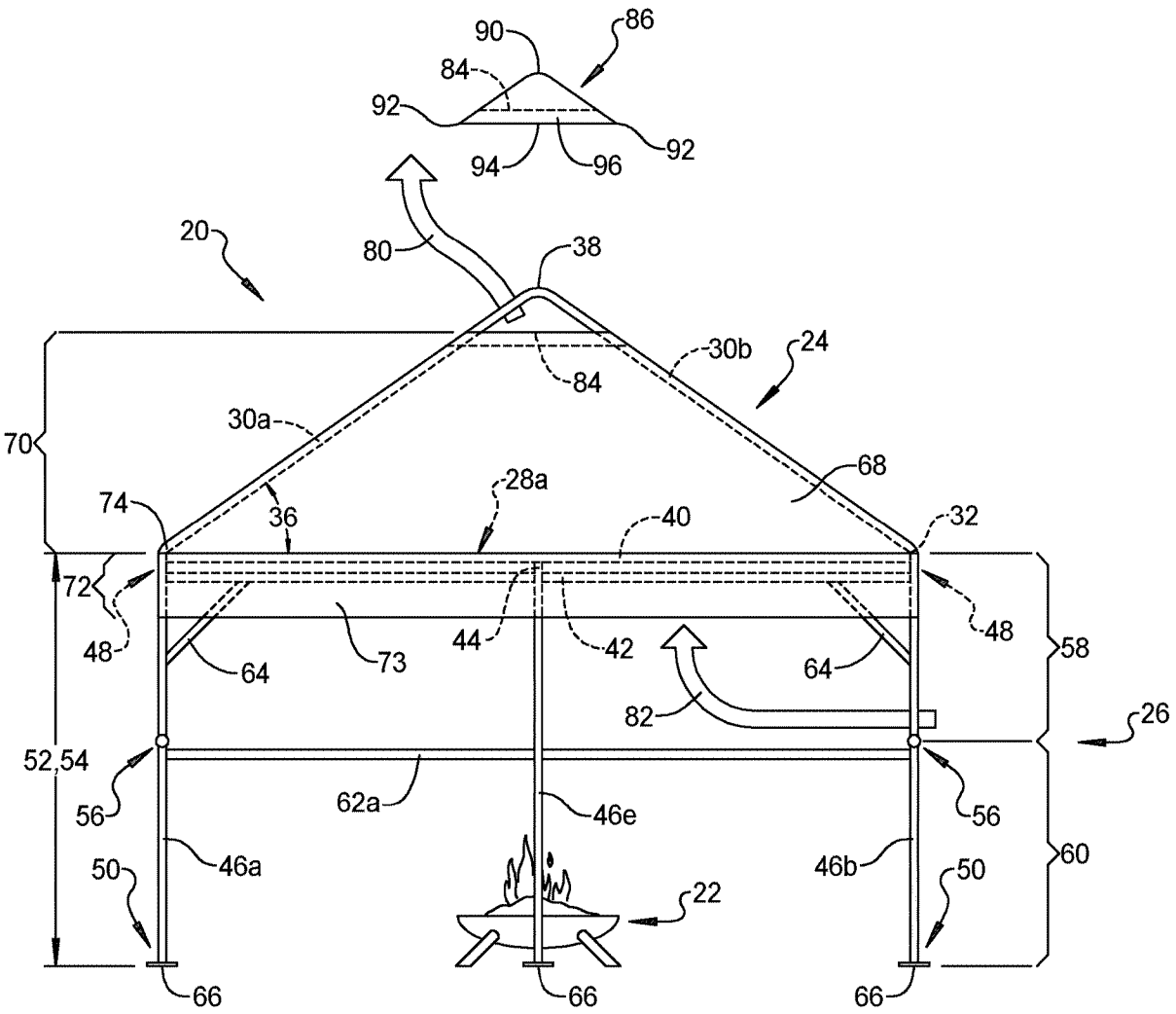
FIG. 4 is a side elevation view of the exemplary portable shelter illustrated in FIG. 1 where the removable top cap is shown exploded out above the canopy.
Figure 5:
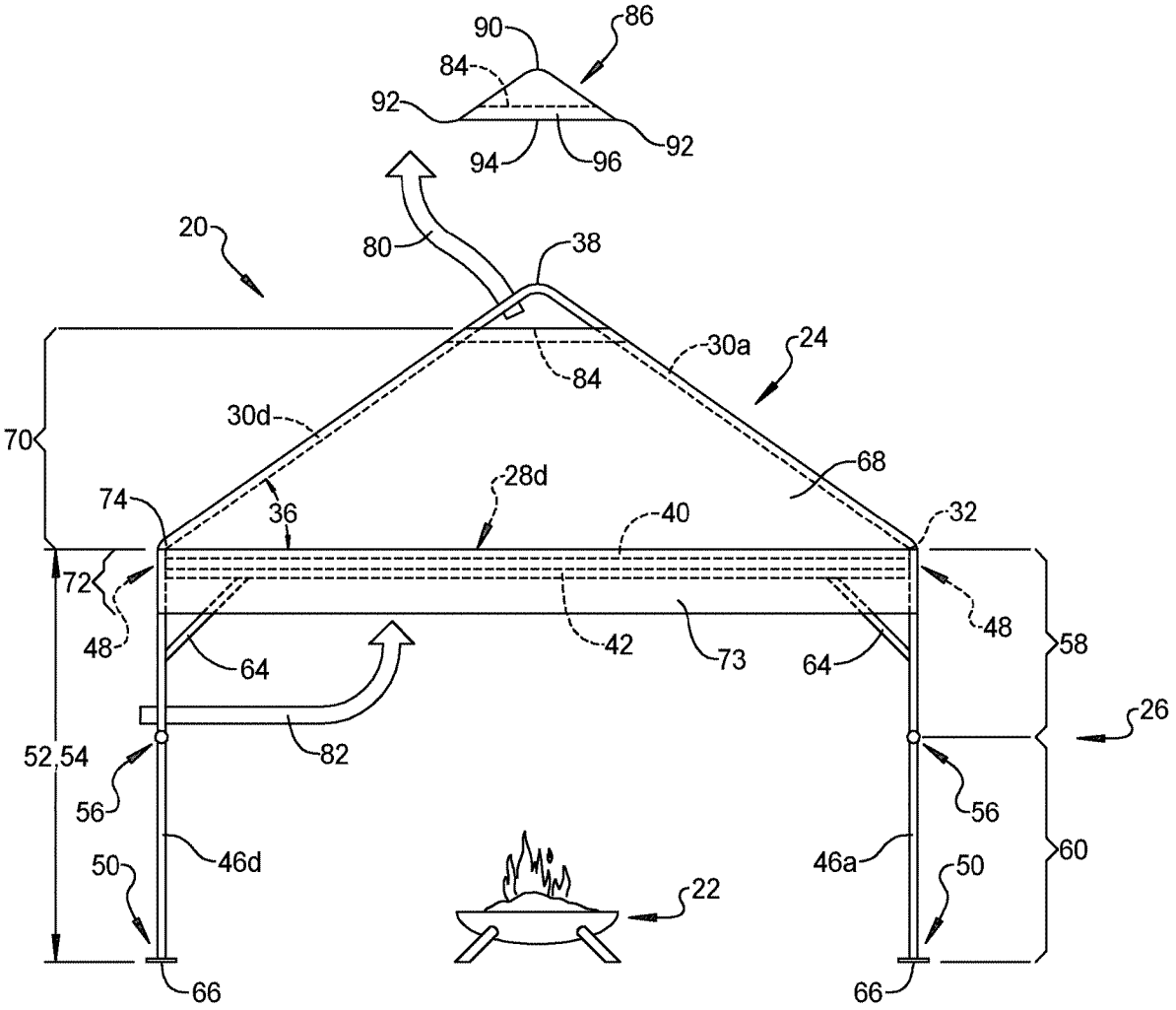
FIG. 5 is a front elevation view of the exemplary portable shelter illustrated in FIG. 1 where the removable top cap is shown exploded out above the canopy.

A rooftop opening 78 is provided in the upper portion 70 of the canopy 68 such that the upper portion 70 of the canopy 68 is open at the rooftop peak 38 of the canopy frame 24. Because the rooftop peak 38 in the illustrated example is centrally located on the canopy frame 24, the rooftop opening 78 is centrally located in the canopy 68. However, it should be appreciated that the rooftop peak 38 and therefore the rooftop opening 78 may be arranged at different off-center positions in the portable shelter 20 without departing from the scope of the subject disclosure. The rooftop opening 78 makes the portable shelter 20 of the subject disclosure suitable for placement over stationary fire pits, portable fire pits, fire rings, camp fires, fire tables, barbeques, grills, cooktops, or other fire sources 22 because the rooftop opening 78 allows smoke, ash, heat, and cinders to vent out from under the canopy 68 without damaging the fabric material of the canopy 68. As shown in FIGS. 4 and 5, when a fire is started on the ground or in a grill or fire pit that is located beneath the canopy 68, the resulting smoke, ash, heat, and cinders exit the canopy 68 through the rooftop opening 78 along flowpath 80. The heat generated by the fire creates convection currents 82 where cooler air is pulled into the portable shelter 20 through the open sides where it is entrained with rising hot air from the fire source 22 and expelled through the rooftop opening 78. This venturi effect scavenges smoke out of the portable shelter 20 and helps prevent smoke from building up under the canopy 68.

Figure 6:
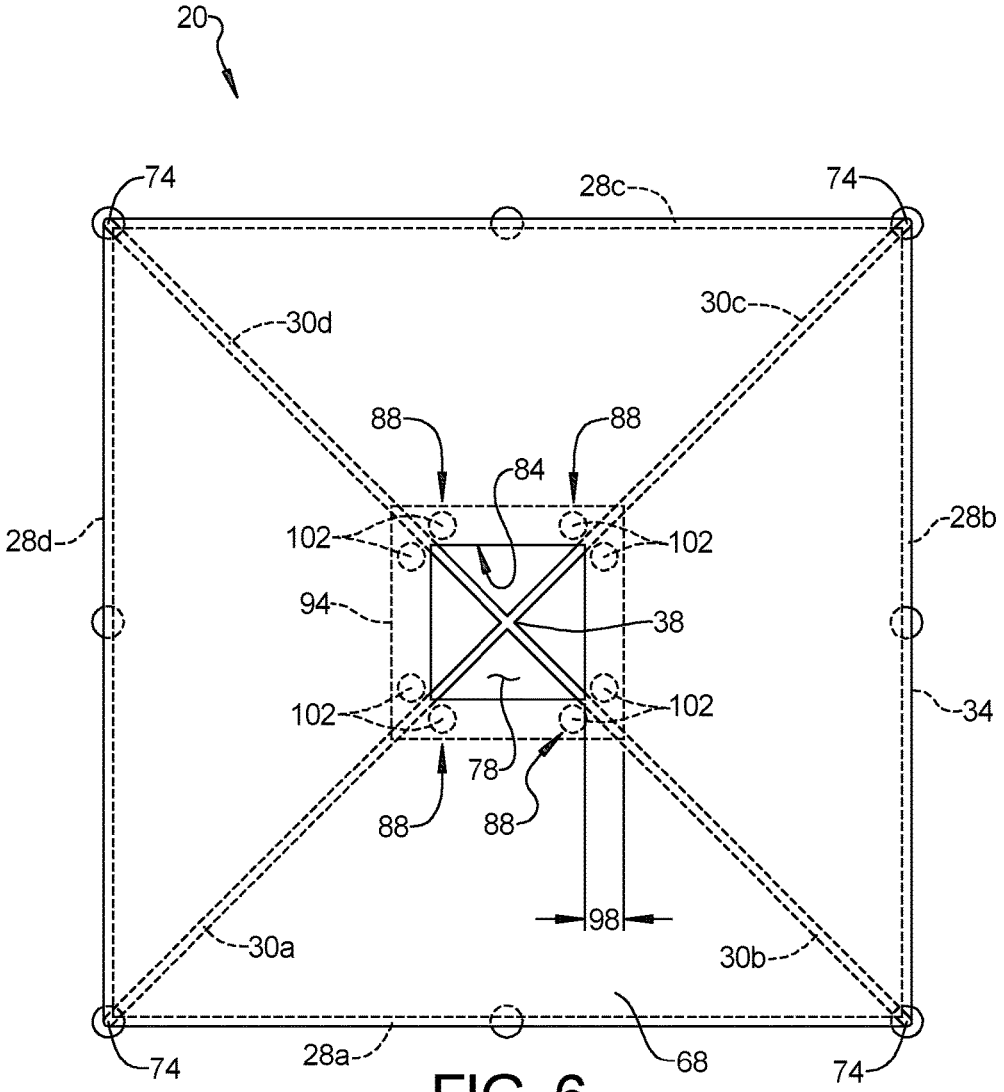
FIG. 6 is a top plan view of the exemplary portable shelter illustrated in FIG. 1 where the removable top cap has been removed.

With additional reference to FIG. 6, the rooftop opening 78 has an opening perimeter 84. Although other constructions are possible, in the illustrated example, the opening perimeter 84 is provided as a reinforced edge of the canopy 68. Opening perimeter 84 is sized large enough to properly vent smoke without significantly decreasing the surface area of the canopy 68. While the size of the opening perimeter 84 may vary depending on the size and design of the portable shelter 20, in the illustrated example, the opening perimeter 84 is approximately 96 inches. Similarly, the shape of the opening perimeter 84 may vary depending on the shape and design of the portable shelter 20. In the illustrated example, the opening perimeter 84 is square in shape.

The portable shelter 20 includes a removable top cap 86 that is releasably retained over the rooftop opening 78 by a magnetic coupling 88. The removable top cap 86 is also made of a fabric material so that is can be folded or rolled up when not in use. The removable top cap 86 allows the rooftop opening 78 to be closed when not in use (i.e., when there is no fire or other fire source being used inside the portable shelter 20). The plurality of roof support beams 30*a-d* extend through the rooftop opening 78. As a result, the rooftop peak 38, which is formed at the convergence of the roof support beams 30*a-d*, is positioned above the rooftop opening 78. When viewed from above (FIG. 6), the rooftop peak 38 is also centrally aligned with the rooftop opening 78. As a result, the rooftop peak 38 of the canopy frame 24 supports the removable top cap 86 and prevents the removable top cap 86 from drooping into or falling through the rooftop opening 78.

Figure 3:
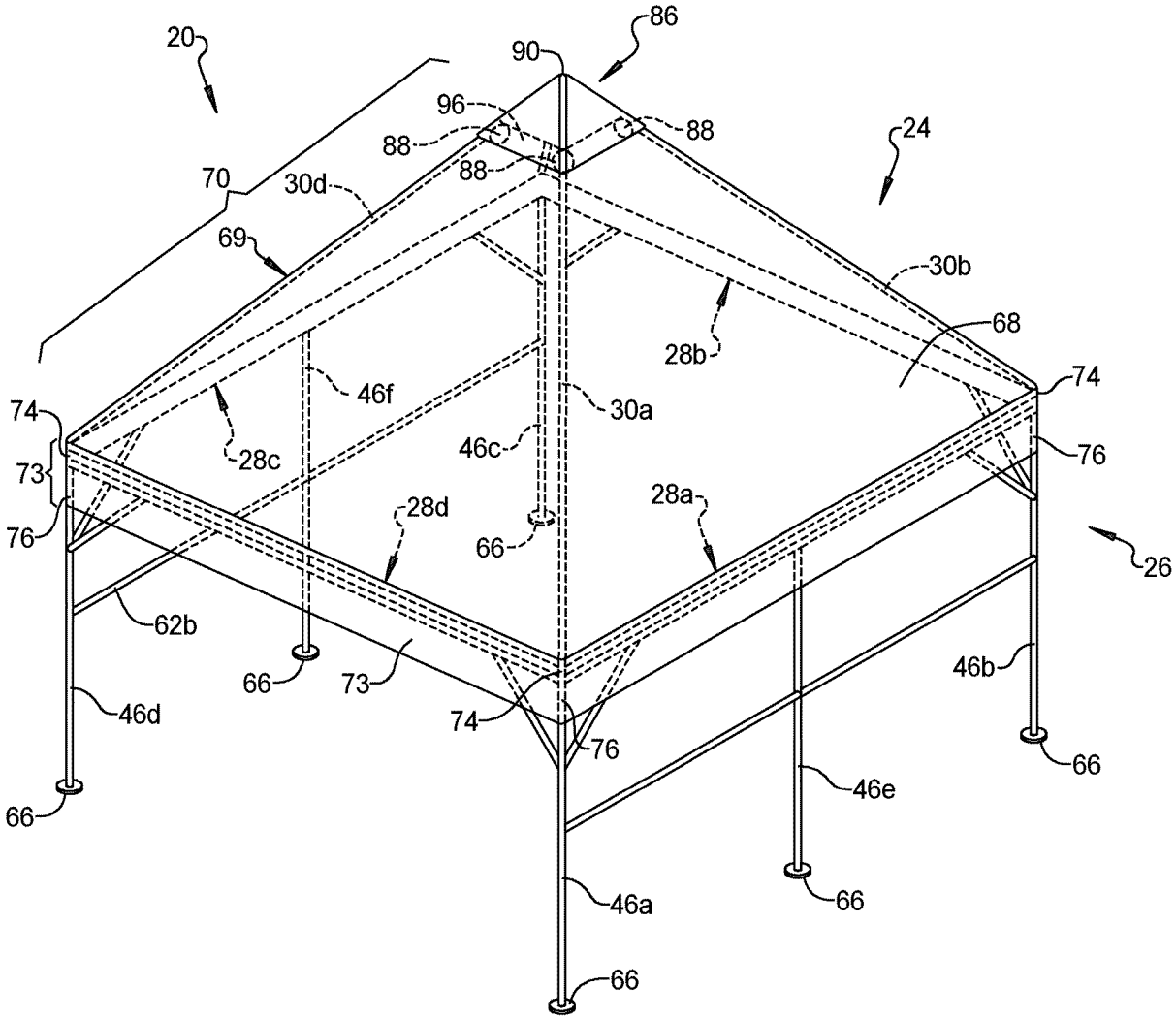
FIG. 3 is another front perspective view of the exemplary portable shelter illustrated in FIG. 1 where the removable top cap is shown positioned directly on the canopy.
Figure 7:
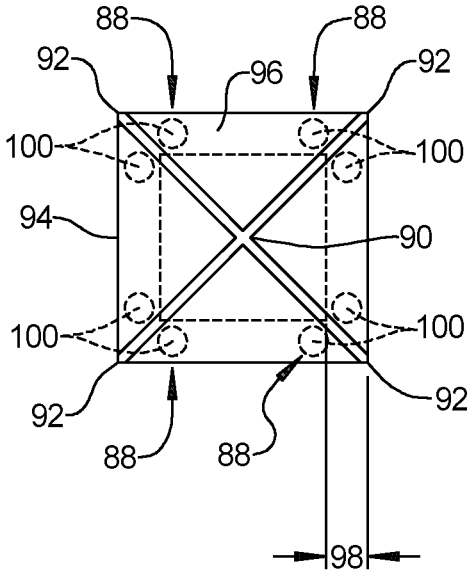
FIG. 7 is a top plan view of the removable top cap of the exemplary portable shelter illustrated in FIG. 1.

With additional reference to FIG. 7, the removable top cap 86 has a peak 90, cap corners 92, and a cap perimeter 94. Although other configurations are possible, in the illustrated example, the cap perimeter 94 is square in shape. The cap perimeter 94 is larger than the opening perimeter 84. The removable top cap 86 therefore has a skirt portion 96, which is the portion of the removable top cap 86 that overlaps with the canopy 68 when the removable top cap 86 is placed directly over the rooftop opening 78 (FIG. 3). The skirt portion 96 of the removable top cap 86 has an overlap with the canopy 68 of at least 4 inches. For example, in the illustrated embodiment, the overlap distance 98 equals 6 inches.

Although other configurations are possible, in the example shown, the magnetic coupling 88 comprises a first set of permanent magnets 100 that are attached to the removable top cap 86 and a second set of permanent magnets 102 that are attached to the canopy 68. More specifically, the first set of permanent magnets 100 are disposed in sewn-in pockets arranged along the skirt portion 96 of the removable top cap 86 near the cap corners 92 of the removable top cap 86. The second set of permanent magnets 102 are disposed in sewn-in pockets arranged along the canopy 68 near the rooftop opening 78 with two permanent magnets disposed on either side of each of the roof support beams 30*a-d*. The permanent magnets in the first and second sets of permanent magnets 100, 102 are aligned with one another and overlap when the removable top cap 86 is placed directly over the rooftop opening 78 (FIG. 3). Although a different number of permanent magnets may be used, in the illustrated embodiment there are eight permanent magnets in the first set of permanent magnets 100 and eight permanent magnets in the second set of permanent magnets 102.

The canopy 68 and the removable top cap 86 may be made of the same material or may be made of different materials. There are a wide variety of different materials that can be used. For example, the canopy 68 and/or removable top cap 86 may be made of polyester, vinyl, canvas, rubber, PVC, or elastomer. However, fire retardant fabrics are preferred. By way of non-limiting example, the canopy 68 and the removable top cap 86 may be made from a polyester fabric that is certified as fire retardant under NFPA-701 standards.

Figure 8:
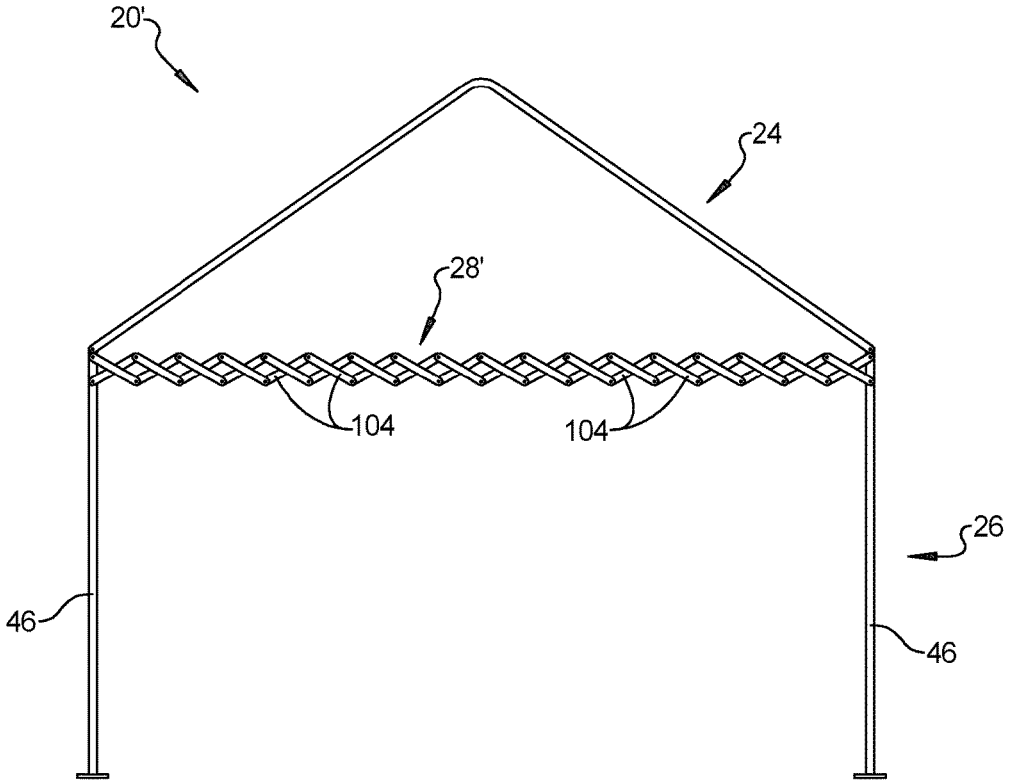
FIG. 8 is a side elevation view of another exemplary portable shelter constructed in accordance with the subject disclosure where the canopy frame and base of the portable shelter are shown.

FIG. 8 illustrates an alternative embodiment of a portable shelter 20' that includes a plurality of frame support beams 28' that are formed of a plurality of interconnected scissor links 104. In accordance with these designs, the intermediary legs 46*a*, 46*b*, cross-beams 62*a*, 62*b*, and corner braces 64 shown in FIGS. 1-5 have been eliminated. The plurality of interconnected scissor links 104 allow the corner legs 46 to collapse in towards one another for transportation and storage.

Figure 9:
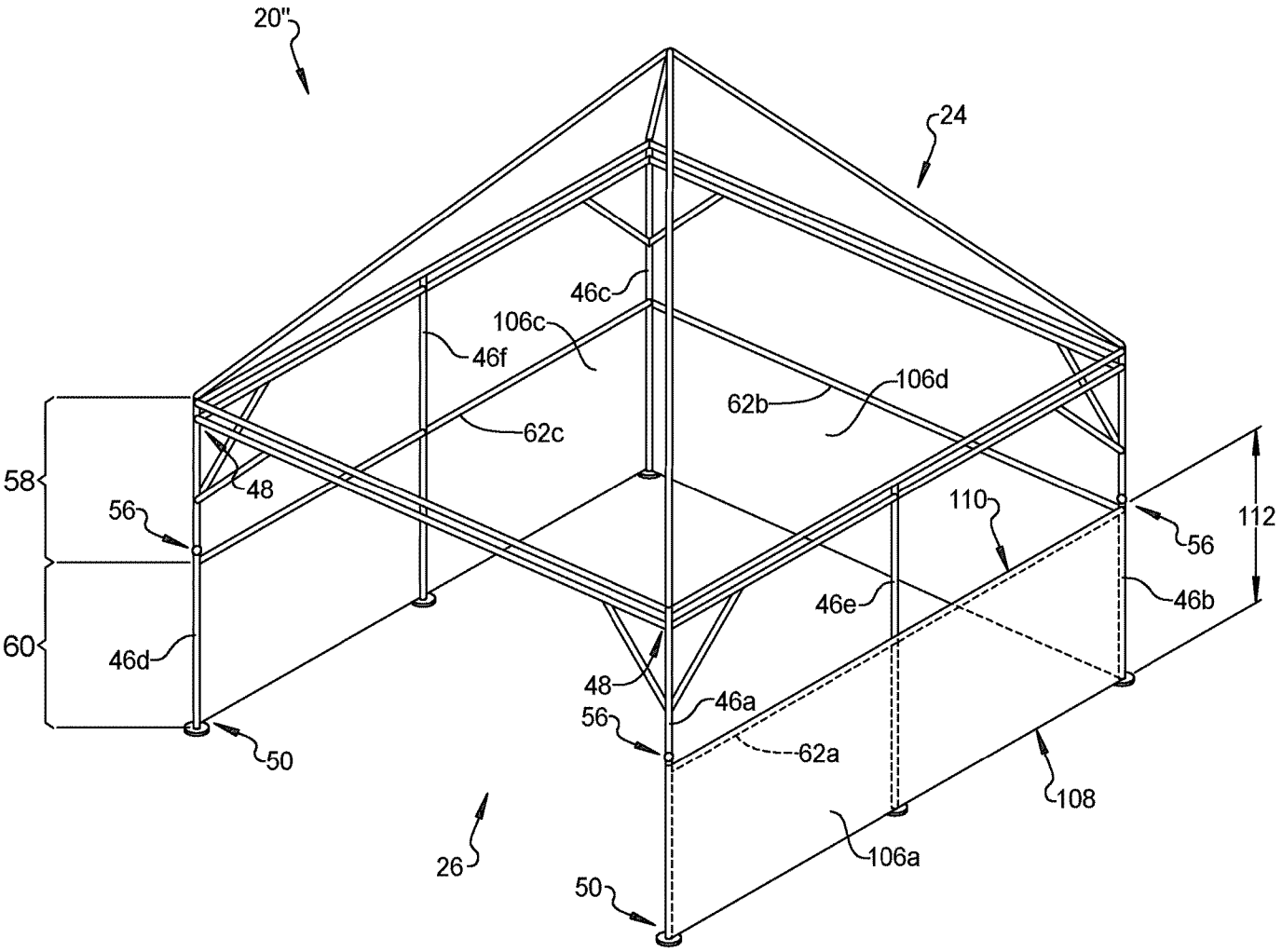
FIG. 9 is a front perspective view of another exemplary portable shelter constructed in accordance with the subject disclosure where the canopy frame, base, and partial side curtains of the portable shelter are shown.
Figure 10:
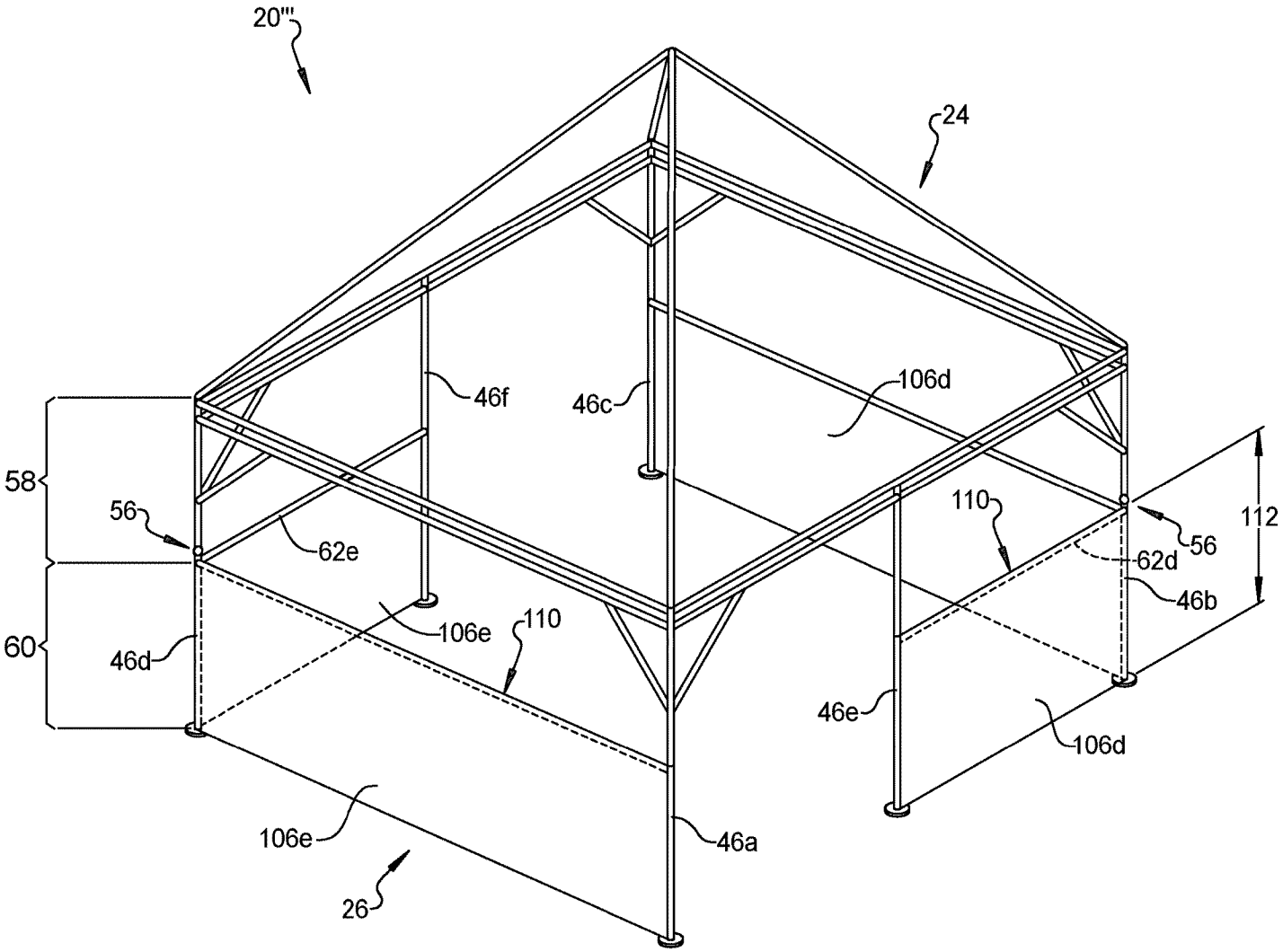
FIG. 10 is a front perspective view of another exemplary portable shelter constructed in accordance with the subject disclosure where the canopy frame, base, and partial side curtains of the portable shelter are shown.

FIGS. 9 and 10 illustrate alternative embodiments of a portable shelter 20", 20'" that includes one or more partial side curtains 106*a-e* that attach to the lower half 60 of the base 26. The partial side curtains 106*a-e* are made from a fabric material, which may be the same material as the canopy 68 and/or removable top cap 86 or a different material. The partial side curtains 106*a-e* extend horizontally between two of the legs 46*a-f* at a position below the midpoint 56 of the legs 46*a-f* such that the at least one partial side curtain 106*a-e* covers only a portion of the lower half 60 of the base 26 and does not extend above the midpoint 56 of the legs 46. Accordingly, the upper half 58 of the base 26 remains open.

Each of the partial side curtains 106*a-e* extends vertically between a lower edge 108 that is positioned adjacent to the lower end 50 of the legs 46*a-f* and an upper edge 110 that is positioned at or below the midpoint 56 of the legs 46*a-f*. Thus, the partial side curtains 106*a-e* have a side curtain height 112, measured between the lower edge 108 and the upper edge 110, that is less than or equal to half of the base height 54. By way of non-limiting example, the side curtain height 112 is approximately 35 inches in the illustrated examples. The partial side curtains 106*a-e* provide a wind break for a fire source 22 positioned inside the portable shelter 20 and therefore prevents wind from putting the fire out or making it difficult for the fire to start. The partial side curtains 106*a-e* also provide a wind break for people sitting within the portable shelter 20 while still permitting sufficient airflow into the portable shelter 20 to feed the convection currents 82 that pull the smoke, ash, heat, and cinders from the fire source 22 up through the rooftop opening 78. The partial side curtains 106*a-e* help to trap radiant heat created by the fire source 22, which provides additional warmth for people sitting within the portable shelter 20. Additionally, the one or more partial side curtains 106*a-e* do not obstruct the view out of the portable shelter 20 regardless of whether a person is sitting or standing inside the portable shelter 20.

In FIG. 9, portable shelter 20" is illustrated. The first cross-beam 62*a* extends between the first and second corner legs 46*a*, 46*b*, the second cross-beam 62*b* extends between the second and third corner legs 46*b*, 46*c*, and the third cross-beam 62*c* extends between the third and fourth corner legs 46*c*, 46*d*. A first partial side curtain 106*a* extends between the first corner leg 46*a* and the second corner leg 46*b*, a second partial side curtain 106*b* extends between the second corner leg 46*b* and the third corner leg 46*c*, and a third partial side curtain 106*c* extends between the third corner leg 46*c* and the fourth corner leg 46*d*. The upper edge 110 of each partial side curtain 106*a-c* is attached to and supported by one of the one cross-beams 62*a-c*. Accordingly, the partial side curtains 106*a-c* in this design extend around three sides of the lower half 60 of the base 26. Accordingly, the partial side curtains 106*a-c* provide a wind block on all sides of the portable shelter 20" except for one, which can be used for ingress and egress.

In FIG. 10, portable shelter 20'" includes a first partial cross-beam 62*d* that extends between the second corner leg 46*b* and the first intermediary leg 46*e* and a second partial cross-beam 62*e* that extends between the third corner leg 46*c* and the second intermediary leg 46*f*. A first partial side curtain 106*d* extends from the first intermediary leg 46*e*, past the second corner leg 46*b*, and to the third corner leg 46*c* and a second partial side curtain 106*e* extends from the second intermediary leg 46*f*, past the fourth corner leg 46*d*, and to the first corner leg 46*a*. As such, the first and second partial side curtains 106*d*, 106*e* in this design have an opposing L-shape arrangement. Again, the upper edge 110 of each of the partial side curtains 106*d*, 106*e* are attached to and supported by one of the partial cross-beams 62*d*, 62*e*. In accordance with this design, the partial side curtains 106*d*, 106*e* provide a wind block on all sides of the portable shelter 20'" because there is no straight path through which wind can travel through the portable shelter 20'". At the same time, this design provides open sections/doors on two opposing sides of the portable shelter 20'" for ingress and egress.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the subject disclosure, and all such modifications are intended to be included within the scope of the subject disclosure.

What is claimed is:

1. A portable shelter comprising:

a canopy frame including a plurality of frame support beams and a plurality of roof support beams;

said plurality of frame support beams being connected at corner junctions to define a frame perimeter;

said plurality of roof support beams extending from said corner junctions to a rooftop peak;

a base, connected to said canopy frame, that includes a plurality of legs;

said plurality of legs including corner legs that are connected to said plurality of frame support beams at said corner junctions;

a canopy extending over and attached to said canopy frame to form a roof;

a rooftop opening in said canopy positioned such that said canopy is open at said rooftop peak of said canopy frame; and a removable top cap that is releasably retained over said rooftop opening by a magnetic coupling.

2. The portable shelter as set forth in claim 1, wherein said magnetic coupling comprises a first set of permanent magnets attached to said removable top cap and a second set of permanent magnets attached to said canopy adjacent to said rooftop opening.

3. The portable shelter as set forth in claim 2, wherein said rooftop opening has an opening perimeter and wherein said removable top cap has a cap perimeter that is larger than said opening perimeter to define a skirt portion of said removable top cap that overlaps with said canopy.

4. The portable shelter as set forth in claim 3, wherein said first set of permanent magnets are disposed in sewn-in pockets arranged along said skirt portion of said removable top cap and said second set of permanent magnets are disposed in sewn-in pockets arranged along said canopy, adjacent to said rooftop opening, with two permanent magnets disposed on either side of each of said roof support beams.

5. The portable shelter as set forth in claim 3, wherein said skirt portion of said removable top cap has an overlap with said canopy of at least 4 inches.

6. The portable shelter as set forth in claim 1, wherein said plurality of roof support beams extend through and above said rooftop opening adjacent said rooftop peak such that said removable top cap is supported by said rooftop peak of said canopy frame.

7. The portable shelter as set forth in claim 1, wherein said canopy and said removable top cap are made from a fabric material.

8. The portable shelter as set forth in claim 1, wherein each of said frame support beams comprises an upper horizontal tube and a lower horizontal tube that are spaced apart, run parallel to each other, and are connected by vertical junction tubes.

9. The portable shelter as set forth in claim 1, wherein said plurality of frame support beams comprises a plurality of interconnected scissor links.

10. A portable shelter comprising:

a canopy frame including a plurality of frame support beams and a plurality of roof support beams;

said plurality of frame support beams being connected at corner junctions to define a frame perimeter;

said plurality of roof support beams extending from said corner junctions to a rooftop peak;

a base, connected to said canopy frame, that includes a plurality of legs;

said plurality of legs including corner legs that are connected to said plurality of frame support beams at said corner junctions;

each of said legs having an upper end that is connected to at least one of said plurality of frame support beams, a lower end opposite said upper end, a leg length that defines a height of said base, and a midpoint located along said leg length;

said base having an upper half disposed above said midpoint of said plurality of legs and a lower half disposed below said midpoint of said plurality of legs;

a canopy extending over and attached to said canopy frame to form a roof;

a rooftop opening in said canopy located such that said canopy is open at said rooftop peak of said canopy frame; and at least one partial side curtain, attached to said base, that extends between two of said legs at a position below said midpoint of said legs such that said at least one partial side curtain covers only a portion of said lower half of said base, wherein said plurality of legs includes a first corner leg, a second corner leg, a third corner leg, a fourth corner leg, a first intermediary leg arranged between said first and second corner legs, and a second intermediary leg arranged between said third and fourth corner legs, wherein said at least one partial side curtain includes a first partial side curtain that extends between said first corner leg and said second corner leg, a second partial side curtain that extends between said second corner leg and said third corner leg, and a third partial side curtain that extends between said third corner leg and said fourth corner leg such that said partial side curtains extend around three sides of said lower half of said base.

11. A portable shelter comprising:

a canopy frame including a plurality of frame support beams and a plurality of roof support beams;

said plurality of frame support beams being connected at corner junctions to define a frame perimeter;

said plurality of roof support beams extending from said corner junctions to a rooftop peak;

a base, connected to said canopy frame, that includes a plurality of legs;

said plurality of legs including corner legs that are connected to said plurality of frame support beams at said corner junctions;

each of said legs having an upper end that is connected to at least one of said plurality of frame support beams, a lower end opposite said upper end, a leg length that defines a height of said base, and a midpoint located along said leg length;

said base having an upper half disposed above said midpoint of said plurality of legs and a lower half disposed below said midpoint of said plurality of legs;

a canopy extending over and attached to said canopy frame to form a roof;

a rooftop opening in said canopy located such that said canopy is open at said rooftop peak of said canopy frame; and at least one partial side curtain, attached to said base, that extends between two of said legs at a position below said midpoint of said legs such that said at least one partial side curtain covers only a portion of said lower half of said base, wherein said plurality of legs includes a first corner leg, a second corner leg, a third corner leg, a fourth corner leg, a first intermediary leg arranged between said first and second corner legs, and a second intermediary leg arranged between said third and fourth corner legs, wherein said at least one partial side curtain includes a first partial side curtain that extends from said first intermediary leg, past said second corner leg, and to said third corner leg and a second partial side curtain that extends from said second intermediary leg, past said fourth corner leg, and to said first corner leg such that said first and second partial side curtains have an opposing L-shape arrangement.

12. The portable shelter as set forth in claim 11, wherein said first and second partial side curtains do not extend above said midpoint of said legs such that said upper half of said base remains open.

13. The portable shelter as set forth in claim 12, wherein said first and second partial side curtains extend horizontally between said legs and vertically between a lower edge adjacent to said lower end of said legs and an upper edge positioned at or below said midpoint of said legs, said first and second partial side curtains having a side curtain height, measured between said lower edge and said upper edge, that is less than or equal to half of said height of said base.

14. The portable shelter as set forth in claim 13, wherein said base includes cross-beams that extend between said legs and that are connected to said legs between said lower end and said midpoint of said legs and wherein said upper edge of said first and second partial side curtains are attached to and supported by said cross-beams.

* * * * *